US005671845A

United States Patent [19]

Harris

[11] Patent Number: 5,671,845

[45] Date of Patent: Sep. 30, 1997

[54] WRAP-AROUND CARRIER PANEL LOCK AND ARTICLE RETAINER

[75] Inventor: Randall L. Harris, Powder Springs, Ga.

[73] Assignee: Riverwood International Corporation, Atlanta, Ga.

[21] Appl. No.: 709,430

[22] Filed: Sep. 6, 1996

[51] Int. Cl.[6] ..... B65D 71/18

[52] U.S. Cl. ..... 206/434; 206/140; 229/103.2

[58] Field of Search ..... 206/139, 140, 206/141, 148, 149, 427, 429, 430, 431, 434, 156, 157; 229/198.2, 103.2

[56] References Cited

U.S. PATENT DOCUMENTS

| | | | |
|---|---|---|---|
| 3,248,004 | 4/1966 | Weiss | 206/140 |
| 5,094,347 | 3/1992 | Schuster | 206/434 |
| 5,390,848 | 2/1995 | Gungner | 206/140 |
| 5,437,363 | 8/1995 | Gungner | 206/140 |
| 5,443,203 | 8/1995 | Sutherland | 206/427 |
| 5,484,059 | 1/1996 | Sutherland | 206/434 |
| 5,524,756 | 6/1996 | Sutherland | 206/140 |
| 5,605,228 | 2/1997 | Baxter | 206/434 |

*Primary Examiner*—Paul T. Sewell
*Assistant Examiner*—Luan K. Bui

[57] ABSTRACT

A wrap-around carrier suitable for packaging bottles. The bottom panel is formed from an inner flap to which article retainer tabs and locking tabs are hinged and an outer flap to which retainer support tabs are hinged. The locking tabs extend up partially through openings in the inner bottom panel flap and engage the retainer support tabs, which in turn support the article retainer tabs. Slits in the outer bottom panel flap extending from the openings receive remaining portions of the locking tabs.

20 Claims, 5 Drawing Sheets

WRAP-AROUND CARRIER PANEL LOCK AND ARTICLE RETAINER

FIELD OF THE INVENTION

This invention relates to wrap-around carriers which incorporate end stops or retainers to prevent outward movement of the packaged articles. More particularly, it relates to a carrier of this type in which the retainer is compatible with the mechanical locks that connect the bottom panel flaps of the carrier to each other.

BACKGROUND OF THE INVENTION

Wrap-around article carriers are commonly designed to have ends which are either partially or entirely open. In either case the carriers must be provided with means for preventing the articles from falling out the ends. Beverage cans, for example, are held in place partly by the tension applied by the carrier blank being wrapped very tightly about them and by the engagement of the top and bottom flanges of the cans with the edges of cutouts in the side panels of the carrier through which the flanges of the can extend. Bottles are more difficult to retain in open-ended carriers than cans due to their shape. Even though cutouts may be provided in the side panels of a carrier to receive the heel portions of bottles, their tapered or necked configuration makes it difficult to apply the carrier wrapper as tightly as in the case of cans.

A preferred means for preventing outward movement of bottles in a wrap-around carrier is disclosed in U.S. Pat. No. 5,094,347, issued Mar. 10, 1992 in the name of Richard D. Schuster. This patent discloses a bottle retainer or stop at each end of the bottom panel which extends between the curved spaced portions of adjacent end bottles. The stops are formed from retainer tabs in the outer bottom panel flap which are folded into final shape when pushed through openings in the inner bottom panel flap. Although the stops perform the desired retaining function, they can be employed only where they do not interfere with the mechanical locks holding the bottom panel flaps together. Thus they could not be used in a carrier which requires mechanical locks to be located adjacent the carrier ends.

Since the bottom panel of a wrap-around carrier cannot be permitted to fail, it is essential that the locking system which connects the bottom panel flaps together be capable of resisting forces caused by the weight of the packaged articles and by the stresses of shipping and handling which tend to pull the locks apart. One approach to this problem utilizes primary and secondary locks. The primary locks connect the flaps together, while the secondary locks function to hold the flaps in place in order to prevent the primary locks from separating.

A preferred locking mechanism is disclosed in U.S. Pat. No. 5,443,203, issued Aug. 22, 1995 in the name of Robert L. Sutherland. In that arrangement the primary locks are integral with the outer bottom panel flap and the secondary locks are integral with the inner bottom panel flap, extending through openings in the outer bottom panel flap. Each secondary lock is in the form of a tab separated by a fold line into a base portion and an end portion. The base portion overlies the end of the outer bottom panel flap and the end portion extends into a locking opening of the outer panel flap. The structure of the secondary locks and the associated opening is such that the secondary locking tabs are prevented from being inadvertently withdrawn, thus not only maintaining the secondary lock in operative condition but also maintaining the primary lock in operative condition.

This locking arrangement, however, does not permit employment of end stops since their location would interfere with the bottom panel locking tab structure.

It would be highly desirable to provide a wrap-around carrier capable of employing both a mechanical locking system of the type disclosed in the Sutherland patent as well as end retaining means of the type disclosed in the Schuster patent.

BRIEF SUMMARY OF THE INVENTION

The invention comprises a wrap-around article carrier containing a plurality of adjacent rows of articles, such as bottles, which have curved bottom portions. Its basic construction includes the typical arrangement of side panels connected to a top panel and to a bottom panel formed of overlapped inner and outer bottom panel flaps. The outer bottom panel flap includes an integral hinged retainer support tab adjacent each end edge of the outer bottom panel flap, the retainer support tabs being folded up from the outer bottom panel flap into the interior of the carrier. The inner bottom panel flap includes an integral hinged article retainer tab adjacent each end edge of the inner bottom panel flap. The article retainer tabs are folded up from the inner bottom panel flap into the interior of the carrier so as to engage the curved bottom portions of adjacent spaced articles and to engage the associated retainer support tab. A locking tab adjacent each article retainer tab extends up through an associated locking opening in the outer bottom panel flap into the interior of the carrier and engages the associated retainer support tab.

By means of this construction the insertion of the locking tabs through the locking openings automatically pushes the hinged retainer support tabs into position, and the pivoting movement of the retainer support tabs in turn causes the article retainer tabs to pivot up into position between the curved bottom portions of adjacent articles. This results in securely held locking tabs and in article retainer stops which are also securely held in place.

In a preferred arrangement both the article retainer tabs and the retainer support tabs are hinged to their bottom panel flaps along fold lines which are substantially parallel to the end edges of the bottom panel flaps. Further, the retainer support tabs include slots through which a corner of the locking tabs extend as a means of locking the assembly together.

The locking openings in the outer bottom panel flap through which the locking tabs extend are at least partially comprised of cutouts resulting from the inward folding of the retainer support tabs. In addition, the locking openings preferably are partially comprised of slits extending from the cutouts as described in more detail below.

Preferably, the retainer tabs include foldably connected side extensions which contact the curved bottom portions of adjacent articles, thus making the resulting retainer stops three dimensional. The retainer stops fit snugly between the spaced bottom portions of the end bottles in the carrier and hold them in place against outward movement. In addition to this function, because the stops interconnect the inner and outer bottom panel flaps they also reinforce any other locking means interconnecting the bottom panel flaps.

The above and other aspects of the invention, as well as other benefits, will readily be apparent from the more detailed description of the preferred embodiment which follows.

DETAILED DESCRIPTION OF THE PREFERRED EMBODIMENT

Figure 1:
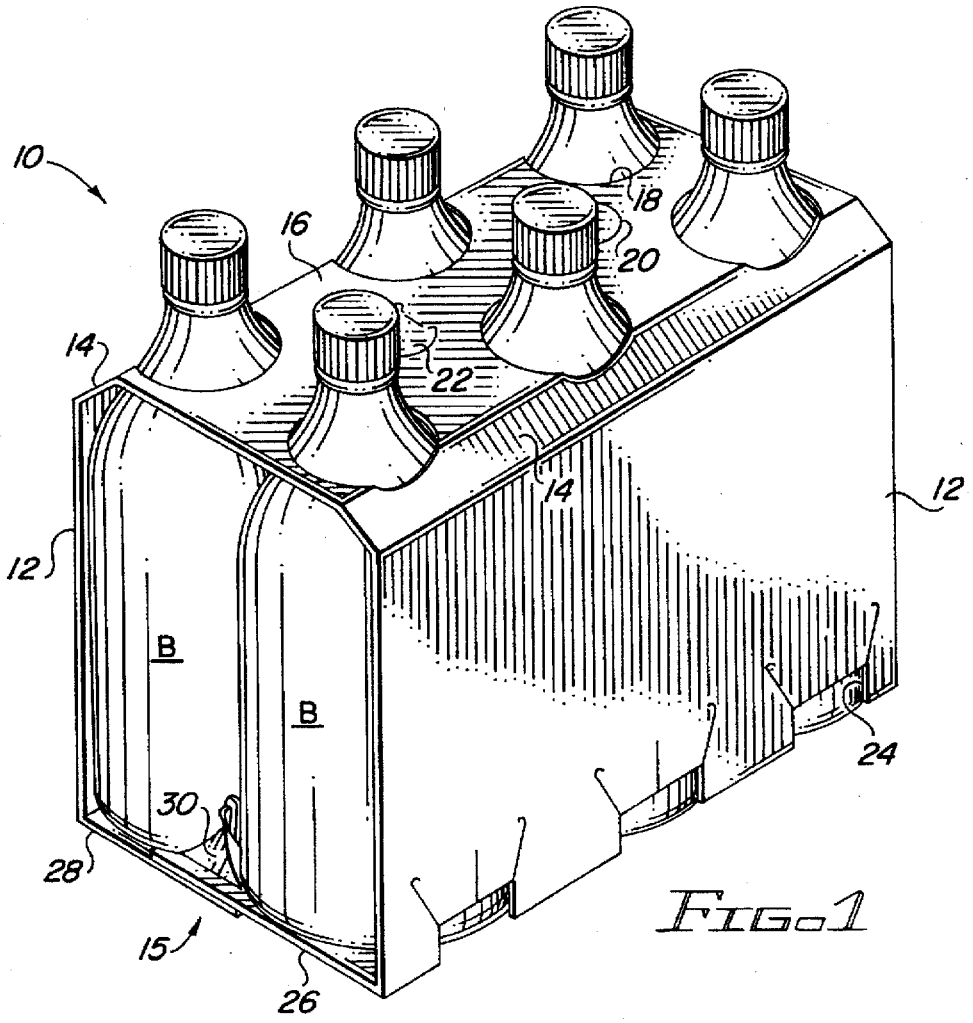
FIG. 1 is a pictorial view of a wrap-around bottle carrier which incorporates the mechanical locking features and the bottle retainer features of the invention.

Referring to FIG. 1, a wrap-around carrier 10 is illustrated in connection with the packaging of six beverage bottles B arranged in two rows of three each. The carrier is comprised of side panels 12 connected at their lower ends to bottom panel 15 and at their upper ends to sloped shoulder panels 14, which in turn are connected to top panel 16. For the purpose of the invention, the shoulder panels should be considered as part of the side panels. Bottle neck openings 18 in the top panel and adjacent portions of the shoulder panels permit the necks of the bottles to extend through the top panel. Included in the top panel are finger holes 20 which provide handle openings for lifting the carrier. Foldable tabs 22 cover the finger holes when the carrier is at rest. The side panels include heel cutouts 24 for receiving the outer bottom portions of the bottles, and the bottom panel 15 is comprised of overlapped inner and outer bottom panel flaps 26 and 28. In addition, extending up from the bottom panel 15 between the outer spaced curved portions of the end bottles B at each end of the carrier is a bottle retainer or stop 30, the details of which are described below.

Figure 2:
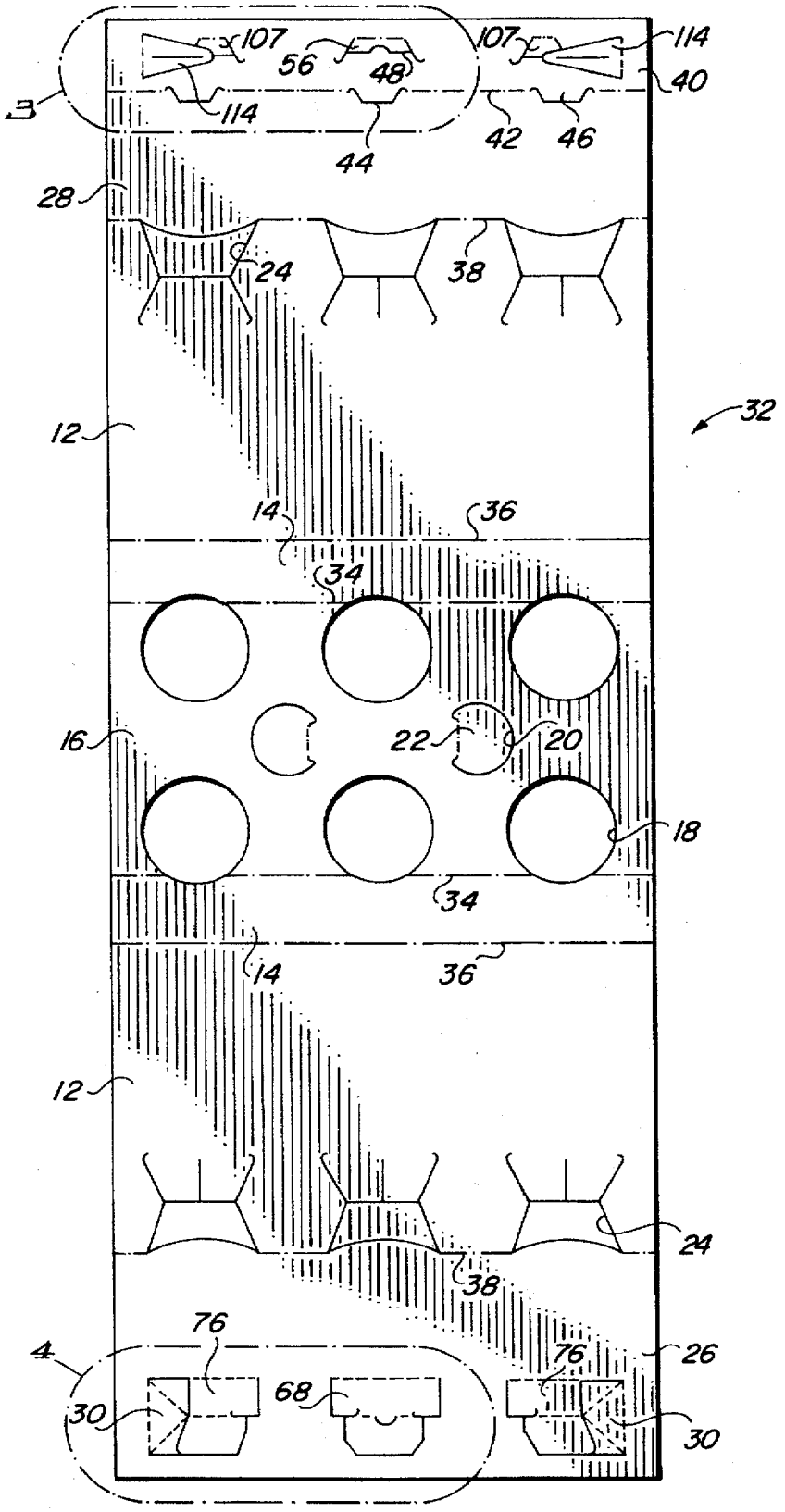
FIG. 2 is a plan view of a blank for forming the carrier of FIG. 1.

A blank 32 for forming the carrier is shown in FIG. 2, wherein similar reference numerals to those used in FIG. 1 denote similar elements. The blank is rectangular in shape and includes straight edges, which makes for an efficient layout of the blanks in a web from which the blanks are cut. Centrally located in the blank is top panel section 16, which is connected by fold lines 34 to shoulder panel sections 14. The shoulder panel sections 14 in turn are connected by fold lines 36 to side panel sections 12. Fold lines 38, which are interrupted by the heel cutouts 24, connect the side panel sections 12 to the bottom panel flaps 26 and 28.

Figure 3:
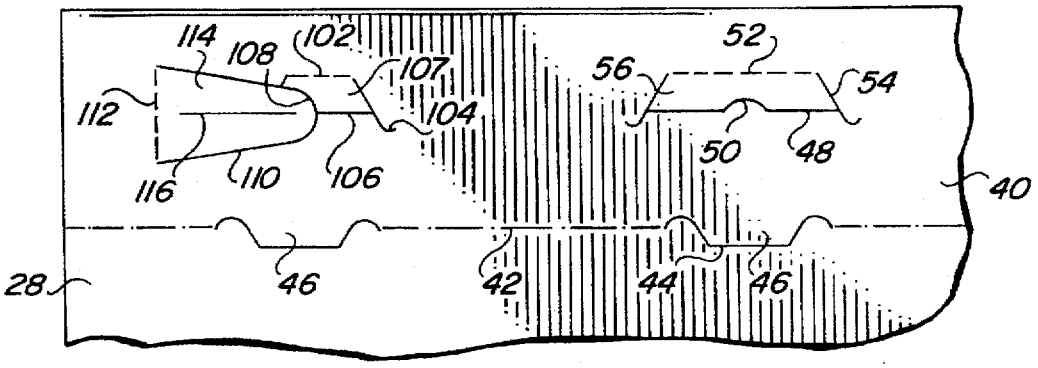
FIG. 3 is an enlarged plan view of the portion of FIG. 2 within the oval 3.

The outer bottom panel flap 28 includes a locking panel section 40 which is connected to the main body of the flap 28 by fold line 42. Interrupting the fold line 42 opposite each heel cutout 24 are spaced slits 44 which form primary locking tabs 46. Located in the locking panel section 40 opposite each primary locking tab are slits which form secondary female locking openings. As best shown in FIG. 3, the centrally located slit 48 includes an outwardly extending arcuate portion forming a small retainer tab 50. Fold line 52 is outwardly spaced from the slit 48, and the ends of the fold line 52 and the slit 48 are connected by transverse slits 54, which extend slightly beyond the slit 48. This arrangement forms retaining tab 56 and is similar to the secondary female locking opening structure disclosed in U.S. Pat. No. 5,443,203.

Figure 4:
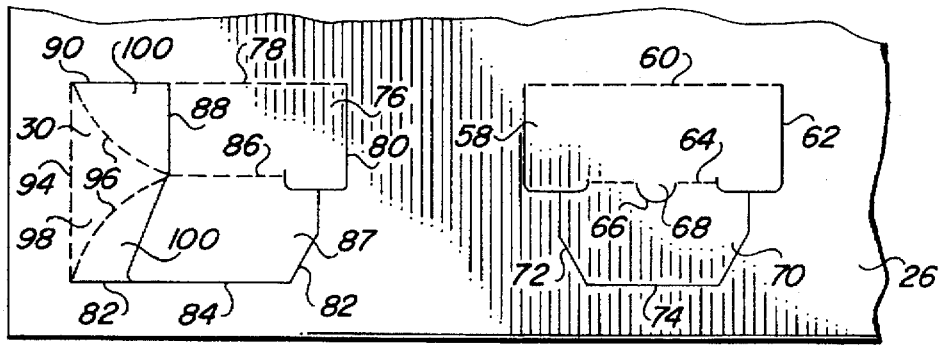
FIG. 4 is an enlarged plan view of the portion of FIG. 2 within the oval 4.

Referring back to FIG. 2, the inner bottom panel flap 26 includes spaced secondary male locking tabs located opposite each heel cutout 24. As best shown in FIG. 4, the centrally located secondary locking tab 58 is connected to the inner bottom panel flap by fold line 60. The main body of the tab 58 is formed by slits 62 the ends of which are connected by fold line 64. The fold line 64 is interrupted by arcuate slit 66, forming tab 68. The secondary locking tab 58 includes a portion 70 formed by slit 72 which extends outwardly of the fold line 64. A straight transverse portion 74 of the slit 72 forms a primary female locking edge which functions as explained below. This arrangement is similar to the secondary locking tab structure disclosed in U.S. Pat. No. 5,443,203.

Still referring to both FIGS. 2 and 4, it can be seen that the end secondary locking tabs 76 are different from the central locking tab 58. The inner portions of the locking tabs 76 are somewhat similar to the structure of locking tab 58, having a fold line 78 corresponding to the fold line 60, slits 80 and 82 corresponding to slits 62 and 72, a straight slit portion 84 corresponding to slit portion 74 and an intermediate fold line 86 corresponding to fold line 64, thereby forming an end portion 87. The outer portions of the locking tabs 76, however, are different. Slit 88 connects the outer ends of fold line 78 and slit 84, and with slits 90 and 92 and fold line 94 forms retainer tab 30. The fold line 94 is substantially parallel to the end edge of the blank and the slits 90 and 92 are extensions of the fold line 78 and the slit 84, respectively. Preferably, the slit 92 is shorter than the slit 90 in order to elongate the end portion 87 of the secondary locking tab 76, as explained further below. Included in the retainer tab 30 are two arcuate fold lines 96 which extend from the ends of the fold line 94 and converge toward fold line 86 to divide the retainer tab into three sections, a main body section 98 and two side sections 100.

Referring back to FIGS. 2 and 3, it can be seen that the structure of the end secondary locking openings is different from the central secondary locking opening. The inner portion of the locking opening structure is similar to that of the central locking opening in that fold line 102 corresponds to fold line 52, end slit 104 corresponds to slit 54 and slit 106 corresponds to slit 48. Fold line 102 and slit 106 are connected, however, by arcuate slit 108, which continues for a substantial distance beyond the slit 106 to form tab 107. Slits 110 diverge from the ends of the slit 108 in the direction of the nearest end edge of the blank, and fold line 112 connects the outer ends of the slits 110. The area bounded by the fold line 112 and the slits 108 and 110 forms a support tab 114 for the retainer tab, as explained below. In addition, each support tab includes an interior slit 116 which is aligned with the slit 106.

Figure 5:
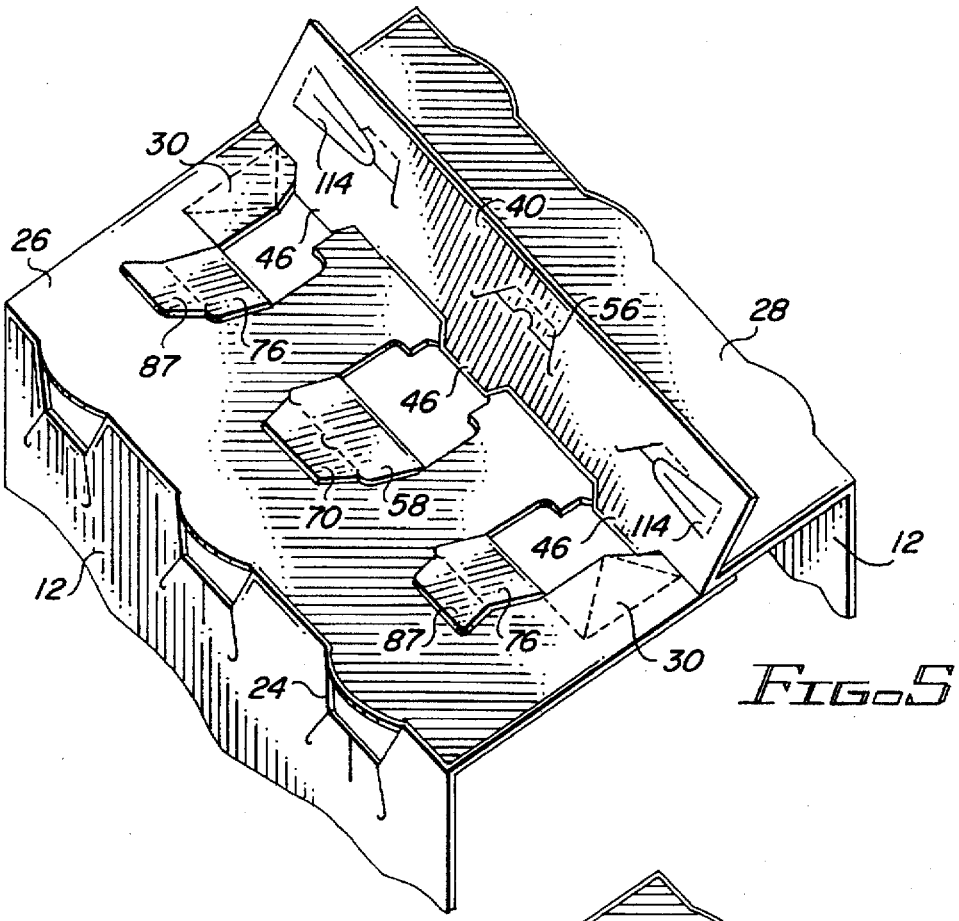
FIG. 5 is a pictorial view of the bottom portion of a carrier, with the bottles removed for the purpose of clarity, demonstrating the first phase of the formation of the bottom panel.
Figure 6:
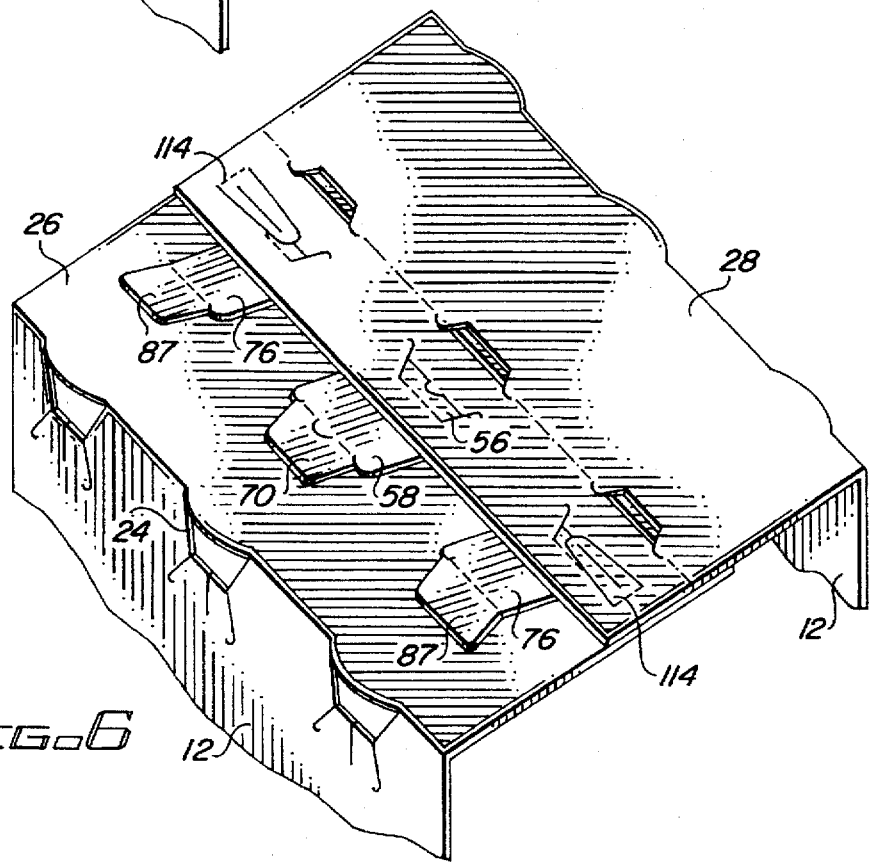
FIG. 6 is a pictorial view similar to that of FIG. 5, but showing the bottom panel flaps at a next intermediate stage of bottom panel formation.

To form a wrap-around package a blank is lowered onto a group of bottles to be packaged so that the necks of the bottles extend up through the bottle neck openings 18 in the top panel section. The blank is then folded along the side panel fold lines and pulled tightly about the bottles in the usual manner so that the bottom panel flaps are overlapped. The locking panel section 40 and the secondary locking tabs 58 and 76 are then folded back as shown in FIG. 5, which omits the bottles for the purpose of clarity, after which the locking panel section is folded down into the final position shown in FIG. 6. During this procedure the primary locking tabs 46 engage the edges of the cutouts formed by the slits 74 and 84 when the secondary locking tabs are folded back, and in their final position are located beneath the inner bottom panel flap 26.

Figure 8:
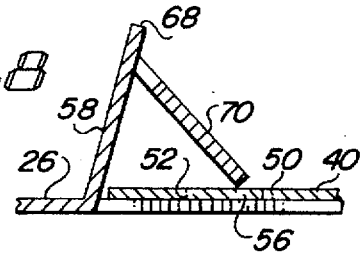
FIG. 8 is an enlarged transverse sectional view taken along line 8—8 of FIG. 7.
Figure 7:
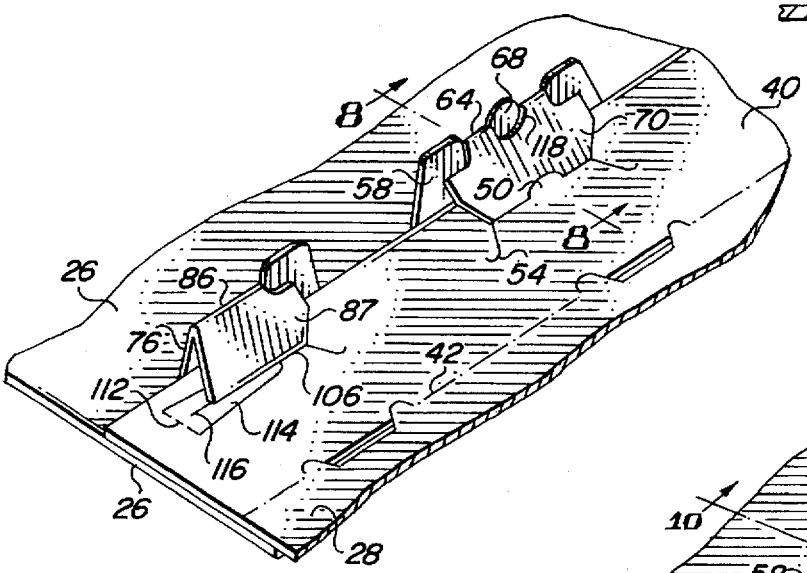
FIG. 7 is a partial pictorial view illustrating the two different secondary male locking tabs in position to be inserted into secondary female locking openings.

As shown in FIGS. 7 and 8, the central secondary locking tab 58 is then pivoted forward about the fold line 60 and its outer portion 70 is folded about the fold line 64 to position the end of the outer portion 70 over the retaining tab 56 of the secondary female locking opening adjacent the tab 50. This causes the tab 68 to separate from the slit 66 to form a cutout or retaining opening 118 of the same shape as the tab 68. The secondary locking tab is then pushed toward the interior of the carrier, during which maneuver the tab 56 is free to pivot as necessary about its fold line 52 to permit the angular entry of the central secondary locking tab into the space created between the tab 56 and the edge formed by the slit 48 of FIG. 3. The transverse slits 54 allow adjacent portions of the locking panel segment 40 to yield slightly to permit continued downward passage of the secondary locking tab.

Figure 9:
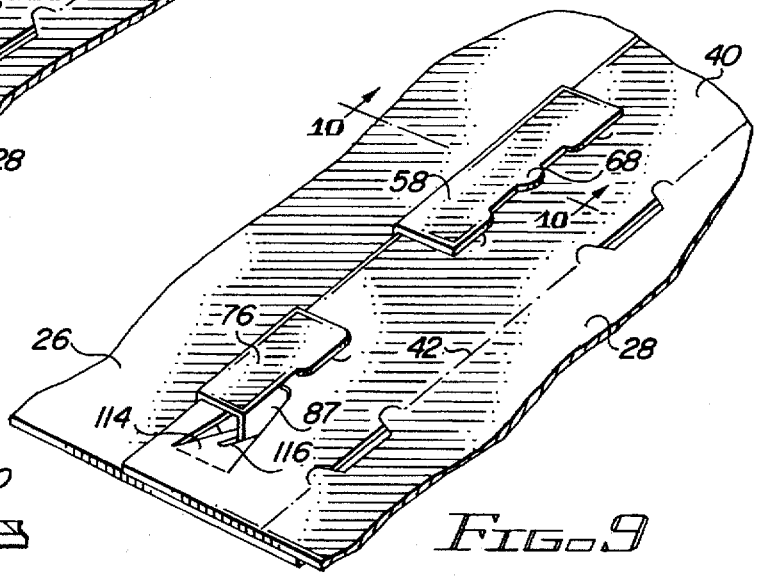
FIG. 9 is a partial pictorial view similar to that of FIG. 7, but illustrating the secondary male locking tabs in their final fully inserted positions.
Figure 10:
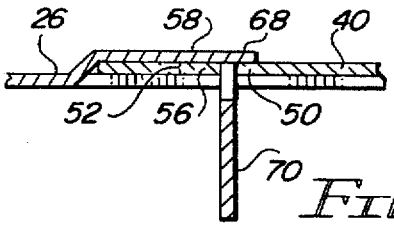
FIG. 10 is an enlarged transverse sectional view taken along line 10—10 of FIG. 9.

Continued movement of the central secondary locking tab results in the tab being fully inserted into the secondary locking opening as shown in FIGS. 9 and 10. During movement of the outer portion 70 of the secondary locking tab 58 through the secondary locking openings, the outer portion 70 contacts and slides past the retaining tab 50. When relative movement between the secondary locking tab portion 70 and the retaining tab 50 brings the retaining cutout 118 of the secondary locking tab opposite the retaining tab 50, the tab 50 readily move into the retaining cutout. Like the locking structure described in U.S. Pat. No. 5,443,203, the retaining tab 50 prevents the secondary locking tab from being forced out of the secondary locking opening, and at the same time the retaining flap 56 prevents the locking tab portion 70 from transversely moving, thereby maintaining the retaining tab in the recess 118.

Referring back to FIG. 7, when the central secondary locking tab 58 is pivoted about the fold line 60 and the outer locking tab portion 70 is folded about the fold line 64, the end secondary locking tabs 76 are also pivoted about their fold lines 78 and their end portions 87 are positioned over the slits 106 of the associated secondary locking openings. When the end flap portion 70 of the central secondary locking tab 58 is pushed through the bottom panel flaps to its final position, the end flap portions 87 of the secondary locking tabs 76 are moved to their fully inserted position shown in FIG. 9. As the locking tabs 76 are moved to their final position the ends of the end flap portions 87 are moved past the slits 106, folding the tabs 107, shown in FIG. 3, in the process. The tabs 107, like the flap 56, are free to pivot when this occurs, allowing the flap end portions 87 to enter at a slight angle. After entry the fold lines 102 of the tabs 107 cause the ends of the flaps 107 to be biased against the flap portions 87, which assists in maintaining the flap portions 87 securely in place.

Figure 11:
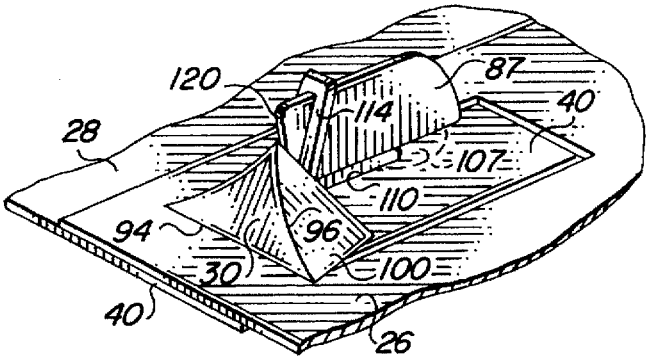
FIG. 11 is a partial pictorial view of an erected retainer stop.
Figure 12:
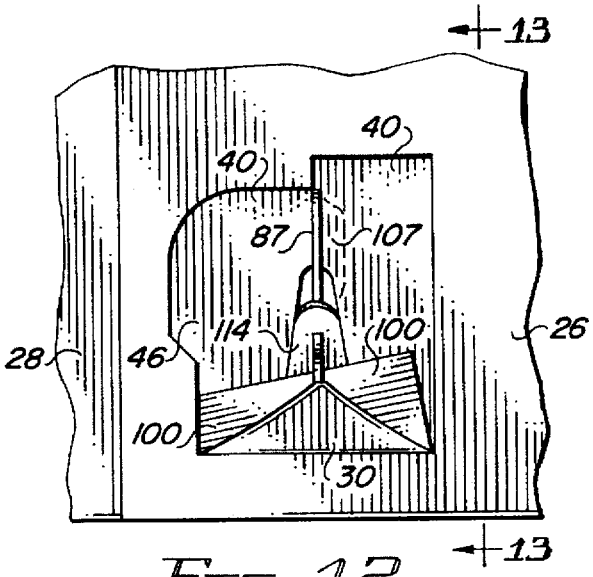
FIG. 12 is a plan view of the retainer stop of FIG. 11.
Figure 13:
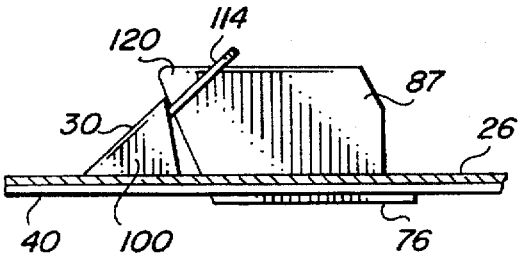
FIG. 13 is a longitudinal sectional view taken along line 13—13 of FIG. 12.
Figure 14:
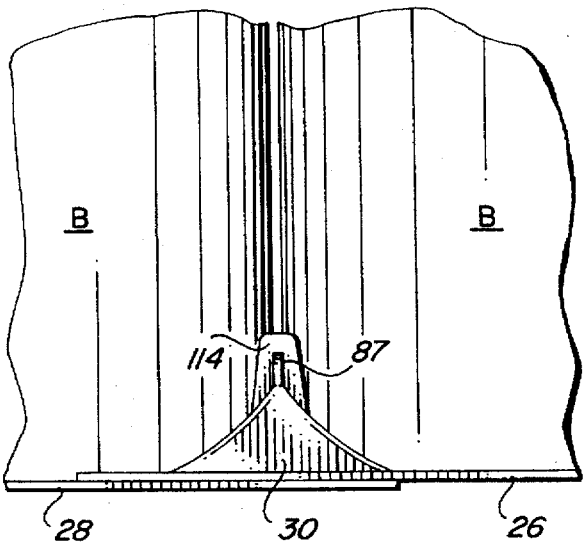
FIG. 14 is an enlarged partial end view of a carrier showing the retainer stop in place between two bottles.

As the flap portions 87 are moved into the interior of the carrier the ends of the flap portions 87 pivot the retainer support tabs 114 about the fold lines 112 toward the interior of the carrier. Although the ends of the flap portions 87 are positioned over the slits 116 of support tabs 114, as shown in FIG. 7, they also engage the solid portion of the support tabs 114 between the inner ends of the slits 116 and the curved slits 108, thereby pushing the support tabs 114 into the interior of the carrier. As will be appreciated, particularly by referring back to FIGS. 5 and 6, the support tabs 114 overlie the retainer stop tabs 30 at the start of this procedure. The inward pivoting of the support tabs 114 therefore causes the retainer stop tabs 30 to pivot inwardly about their fold lines 94. As the retainer stop tabs 30 move into the interior of the carrier the retainer side extensions 100 contact the adjacent bottles, which act as cams, causing the extensions to fold in, giving the retainer stop a three dimensional pyramidal shape. The final condition of the retainer stop 30, the retainer support tab 114 and the end locking tab portion 87 is shown in FIGS. 11–13. Note that the outer corner 120 formed by the elongated upper edge of the end locking tab portion 87 has penetrated the slit 116 in the retainer support tab 114 so that the upper edge of the end portion 87 acts as a support for the support flap 114. Since the retainer tab 30 is supported by the support flap 114, it is securely buttressed. Further, since the corner portion 120 contacts the retainer tab 30, the end portion 87 of the secondary locking tab is prevented from being withdrawn from the interior of the carrier. In addition, as shown in FIG. 14, the squeezing of the retainer side extensions 100 against the sides of the bottles B also acts to hold the retainer stops in place.

As previously noted, the slit 92 is shorter than the slit 90. This results in angling the portion of the slit 88 that forms an edge of the outer tab portion 87, thereby forming the corner 120.

It should now be clear that the invention permits the use of both article retainer stops and secondary locks designed to prevent accidental withdrawal of the secondary locking tab. Insertion of the end secondary locking tabs automatically erects the retainer stops, and at the same time moves the retainer support tabs into place. This cooperative relationship holds the end secondary locking tabs in place. Also assisting is the action of the tab 107 of the end secondary locking openings against the end secondary locking tabs. Fabrication of the carrier is simple and does not require extra steps beyond those normally associated with the use of secondary locking tabs incorporating an intermediate fold line.

Although the carrier lock has been described in connection with a carrier for use with long necked bottles which extend through bottle neck openings in the top panel, it will be obvious that the invention could be employed in conjunction with carriers for wrapping short necked bottles, cans or other types of articles.

It will be apparent that the invention need not be limited to all the specific details described in connected with the preferred embodiment, but that changes to certain features of the preferred embodiment which do not alter the overall basic function and concept of the invention may be made without departing from the spirit and scope of the invention, as defined in the appended claims.

What is claimed is:

1. A wrap-around article carrier containing a plurality of adjacent rows of articles having curved bottom portions, comprising:

a top panel;

opposite side panels connected to the top panel;

a bottom panel comprised of an inner bottom panel flap connected at a side edge thereof to one of the side panels and an outer bottom panel flap connected at a side edge thereof to the other side panel, each bottom panel flap having a free edge opposite the edge connected to a side panel and two end edges;

the outer bottom panel flap including an integral retainer support tab hinged thereto adjacent each end edge of the outer bottom panel flap, the retainer support tabs being folded up from the outer bottom panel flap into the interior of the carrier;

the inner bottom panel flap including an integral article retainer tab hinged thereto adjacent each end edge of the inner bottom panel flap, the article retainer tabs being folded up from the inner bottom panel flap into the interior of the carrier so as to engage the curved bottom portions of adjacent spaced articles and to engage the associated retainer support tab; and the inner bottom panel flap including a locking tab adjacent each article retainer tab, each locking tab extending through an associated locking opening in the outer bottom panel flap into the interior of the carrier and engaging an associated retainer support tab.

2. A wrap-around carrier as defined in claim 1, wherein each retainer support tab includes a slot therein, each locking tab having a corner portion extending through the slot in an associated retainer support tab.

3. A wrap-around carrier as defined in claim 2, wherein each article retainer tab has an upper edge contacting the corner portion of an associated locking tab.

4. A wrap-around carrier as defined in claim 1, wherein the article retainer tabs are hinged to the inner bottom panel flap along fold lines which are substantially parallel to the end edges of the inner bottom panel flap.

5. A wrap-around carrier as defined in claim 4, wherein each article retainer tab includes side extensions connected on opposite sides thereof along fold lines, the side extensions contacting the curved bottom portions of adjacent articles.

6. A wrap-around carrier as defined in claim 5, wherein the fold lines connecting the side extensions to the retainer tabs are curved, converging toward each other from the inner bottom panel flap.

7. A wrap-around carrier as defined in claim 1, wherein each locking tab is connected to the inner bottom panel flap by a fold line spaced from the free edge of the inner panel flap, each locking tab including an intermediate fold line dividing the locking tab into a base portion and an end portion, the base portion of the locking tab extending substantially parallel to and beneath the outer bottom panel flap and the end portion of the locking tab extending through the associated locking opening in the outer bottom panel flap.

8. A wrap-around carrier as defined in claim 7, wherein the locking openings in the outer bottom panel flap are at least partially comprised of cutouts resulting from the inward folding of the retainer support tabs.

9. A wrap-around carrier as defined in claim 8, wherein the locking openings in the outer bottom panel flap are partially comprised of slits extending from the cutouts resulting from the inward folding of the retainer support tabs.

10. A wrap-around carrier as defined in claim 9, wherein the slits extending from the cutouts resulting from the inward folding of the retainer support tabs define outer edges of secondary locking opening tabs.

11. A wrap-around carrier as defined in claim 1, wherein the locking tabs are secondary locking tabs, the outer bottom panel flap containing at least one primary locking tab engaging a primary locking opening in the inner bottom panel flap.

12. A blank for forming a wrap-around carrier for packaging a plurality of adjacent rows of articles having curved bottom portions, comprising:

a generally rectangular sheet having a centrally located top panel section;

side panel sections connected to opposite sides of the top panel section by fold lines, the top panel section and the side panel sections having end edges corresponding to opposite edges of the blank;

an inner bottom panel flap connected to one of the side panel sections along a first fold line and an outer bottom panel flap connected to the other side panel section along a second fold line, each bottom panel flap having a free edge opposite the fold line connecting the bottom panel flap to an associated side panel section and end edges corresponding to opposite edges of the blank;

the outer bottom panel flap including an integral retainer support tab hinged thereto adjacent each end edge of the outer bottom panel flap;

the inner bottom panel flap including an integral article retainer tab hinged thereto adjacent each end edge of the inner bottom panel flap; and the inner bottom panel flap including a locking tab adjacent each article retainer tab;

the locking tabs, article retainer tabs and retainer support tabs being located so that in a carrier formed from the blank each locking tab extends through an associated locking opening in the outer bottom panel flap created by the folding of an associated retainer support tab and engages the associated retainer support tab while the associated retainer support tab engages an associated folded article retainer tab.

13. A wrap-around carrier blank as defined in claim 12, wherein each retainer support tab includes a slot therein, each locking tab having a portion located so as to extend through the slot of an associated retainer support tab in a carrier formed from the blank.

14. A wrap-around carrier blank as defined in claim 12, wherein the article retainer tabs are hinged to the inner bottom panel flap along fold lines which are substantially parallel to the end edges of the inner bottom panel flap.

15. A wrap-around carrier blank as defined in claim 14, wherein each retainer tab includes side extensions connected on opposite sides of the retainer tab along fold lines.

16. A wrap-around carrier blank as defined in claim 15, wherein the fold lines connecting the side extensions to the retainer tabs are curved, converging toward each other away from the adjacent end edge of the inner bottom panel flap.

17. A wrap-around carrier blank as defined in claim 12, wherein each locking tab is connected to the inner bottom panel flap by a fold line spaced from the free edge of the inner bottom panel flap, each locking tab including an intermediate fold line dividing the locking tab into a base portion and an end portion, the base portion of the locking tab being located so as to extend substantially parallel to and beneath the outer bottom panel flap in a carrier formed from the blank, and the end portion of the locking tab extending through an associated locking opening in the outer bottom panel flap of such a carrier.

18. A wrap-around carrier blank as defined in claim 17, wherein the outer bottom panel flap includes a slit extending from each retainer support tab in a direction away from the adjacent end edge of the outer bottom panel flap.

19. A wrap-around carrier blank as defined in claim 18, wherein each retainer support tab includes a slit spaced from and aligned with the slit extending from the retainer support tab.

20. A wrap-around carrier blank as defined in claim 18, wherein the slit extending from each retainer support tab defines an edge of a secondary locking opening tab, said secondary locking opening tab being connected to the outer bottom panel flap by a fold line adjacent the free edge of the outer bottom panel flap.

* * * * *